US009129786B2

(12) United States Patent
Ouyang et al.

(10) Patent No.: US 9,129,786 B2
(45) **Date of Patent: *Sep. 8, 2015**

(54) SYSTEMS AND METHODS FOR ANALYZING A SAMPLE

(71) Applicant: Purdue Research Foundation, West Lafayette, IN (US)

(72) Inventors: Zheng Ouyang, West Lafayette, IN (US); Tsung-Chi Chen, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/305,489

(22) Filed: Jun. 16, 2014

(65) Prior Publication Data

US 2015/0108346 A1 Apr. 23, 2015

Related U.S. Application Data

(63) Continuation of application No. 14/058,856, filed on Oct. 21, 2013, now Pat. No. 8,785,846, which is a continuation of application No. PCT/US2012/037987, filed on May 15, 2012.

(60) Provisional application No. 61/488,244, filed on May 20, 2011.

(51) Int. Cl.
*H01J 49/10* (2006.01)
*H01J 49/04* (2006.01)
(Continued)

(52) U.S. Cl.
CPC ..... *H01J 49/0422* (2013.01); *H01J 49/0013* (2013.01); *H01J 49/0495* (2013.01); *H01J 49/10* (2013.01); *H01J 49/168* (2013.01); *H01J 49/24* (2013.01); *H01J 49/26* (2013.01)

(58) Field of Classification Search
CPC . H01J 49/0404; H01J 49/4265; H01J 49/427; H01J 49/0095; H01J 49/0022; H01J 49/0013; H01J 49/12; H01J 49/0027; H01J 49/0495
See application file for complete search history.

(56) References Cited

U.S. PATENT DOCUMENTS 3,270,773 A 9/1966 Brunnee
4,201,913 A 5/1980 Bursack et al.
(Continued)

FOREIGN PATENT DOCUMENTS

EP 0 770 870 A2 5/1997
JP 56-121256 9/1981
(Continued)

OTHER PUBLICATIONS

Translated Notice of Reasons for Rejection for Patent Application No. 2014-511461 with the mailing date of Oct. 17, 2014 (7 pages).
(Continued)

*Primary Examiner* — Phillip A Johnston
*Assistant Examiner* — Sean Luck
(74) *Attorney, Agent, or Firm* — Brown Rudnick LLP; Adam M. Schoen

(57) ABSTRACT

The invention generally relates to systems and methods for sample analysis. In certain embodiments, the invention provides systems for analyzing a sample that include an electric source, a vacuum chamber including a conducting member, in which the conducting member is coupled to the electric source, a sample introduction member coupled to the vacuum chamber, and a mass analyzer. The system is configured such that a distal end of the sample introduction member resides within the vacuum chamber and proximate the conducting member, such that an electrical discharge may be produced between the sample introduction member and the conducting member. A neutral gas that has been introduced into the vacuum chamber interacts with the generated discharge, producing ions within the vacuum chamber that are subsequently transferred into the mass analyzer in the vacuum chamber.

20 Claims, 8 Drawing Sheets

(51) Int. Cl.

| | |
|---|---|
| ***H01J 49/02*** | (2006.01) |
| ***H01J 49/00*** | (2006.01) |
| ***H01J 49/16*** | (2006.01) |
| ***H01J 49/26*** | (2006.01) |
| ***H01J 49/24*** | (2006.01) |

(56) References Cited

U.S. PATENT DOCUMENTS

| | | | | |
|---|---|---|---|---|
| 4,948,962 | A * | 8/1990 | Mitsui et al. | 250/288 |
| 5,045,694 | A | 9/1991 | Beavis et al. | |
| 5,311,016 | A | 5/1994 | Villa-Aleman | |
| 6,586,731 | B1 | 7/2003 | Jolliffe | |
| 7,335,897 | B2 | 2/2008 | Takats et al. | |
| 2010/0301209 | A1 * | 12/2010 | Ouyang et al. | 250/288 |
| 2011/0108726 | A1 | 5/2011 | Hiraoka et al. | |
| 2011/0253891 | A1 | 10/2011 | Hashimoto et al. | |
| 2012/0112061 | A1 | 5/2012 | Morokuma et al. | |

FOREIGN PATENT DOCUMENTS

| | | | |
|---|---|---|---|
| JP | H08-201294 | A | 8/1996 |
| JP | 2000-230921 | A | 8/2000 |
| WO | 98/36440 | A1 | 8/1998 |

OTHER PUBLICATIONS

M. Acedo, G. Tarrason, J. Piulats, M. Mann, M. Wilm, R. Eritja, Bioorg. Med. Chem. Lett. 1995, 5. 1577.

S. N. Andréasson, H. Mahteme, B. Sahlberg, H. Anundi, Journal of Environmental and Public Health 2012, 2012. 6, DOI: 10.1155/2012/929053.

C. Berchtold, L. Meier, R. Zenobi, International Journal of Mass Spectrometry 2011, 299. 145-150, DOI: 10.1016/j.ijms.2010.10.011.

H. K. Bojes, P. G. Pope, Regulatory Toxicology and Pharmacology 2007, 47. 288-295, DOI: 10.1016/j.yrtph.2006.11.007.

M. C. Bruzzoniti, M. Fungi, C. Sarzanini, Analytical Methods 2010, 2. 739-745.

T.-C. Chen, W. Xu, Z. Ouyang, Rapid Communications in Mass Spectrometry 2011, 25. 3274-3280, DOI: 10.1002/rcm.5226.

J. A. Contreras, J. A. Murray, S. E. Tolley, J. L. Oliphant, H. D. Tolley, S. A. Lammert, E. D. Lee, D. W. Later, M. L. Lee, Journal of the American Society for Mass Spectrometry 2008, 19. 1425-1434, DOI: DOI 10.1016/j.jasms.2008.06.022.

J. Dewulf, H. Van Langenhove, Journal of Chromatography A 1999, 843. 163-177, DOI: 10.1016/s0021-9673(99)00225-3.

S. A. Ecelberger, T. J. Cornish, B. F. Collins, D. L. Lewis, W. A. Bryden, Johns Hopkins APL Technical Digest 2004, 25.

L.A. Eriksson, F. Himo, P. E. M. Siegbahn, G. T. Babcock, The Journal of Physical Chemistry A 1997, 101. 9496-9504, DOI: 10.1021/jp9720451.

L. Gao, R. G. Cooks, Z. Ouyang, Analytical Chemistry 2008, 80. 4026-4032, DOI: 10.1021/ac800014v.

L. Gao, G. Li, Z. Nie, J. Duncan, Z. Ouyang, R. G. Cooks, International Journal of Mass Spectrometry 2009, 283. 30-34, DOI: DOI: 10.1016/j.ijms.2009.01.004.

L. Gao, Q. Song, R. J. Noll, J. Duncan, R. G. Cooks, Z. Ouyang, Journal of Mass Spectrometry 2007, 42. 675-680, DOI: 10.1002/jms.1201.

A. Gifford, in Pittsburgh Conf. Anal. Chem. Appl. Spectrosc., Orlado, Fl. 2012.

A. Graichen, R. Vachet, Journal of the American Society for Mass Spectrometry 2011, 22. 683-688, DOI: 10.1007/s13361-010-0068-6.

J. Grotemeyer, U. Boesl, K. Walter, E. W. Schlag, Organic Mass Spectrometry 1986, 21. 645-653, DOI: 10.1002/oms.1210211008.

O. Hadjar, T. Schlathölter, S. Davila, S. Catledge, K. Kuhn, S. Kassan, G. Kibelka, C. Cameron, G. Verbeck, Journal of the American Society for Mass Spectrometry 2011, 22. 1872-1884, DOI: 10.1007/s13361-011-0213-x.

W. Hanshaw, M. Nutt, J. S. Chickos, Journal of Chemical & Engineering Data 2008, 53. 1903-1913, DOI: 10.1021/je800300x.

K. Hou, W. Xu, J. Xu, R. G. Cooks, Z. Ouyang, Analytical Chemistry 2011, 83. 1857-1861, DOI: 10.1021/ac102962e.

G. Huang, L. Gao, J. Duncan, J. D. Harper, N. L. Sanders, Z. Ouyang, R. G. Cooks, Journal of the American Society for Mass Spectrometry 2010, 21. 132-135.

C. Janfelt, R. Græsbøll, F. R. Lauritsen, International Journal of Environmental Analytical Chemistry 2011, 92. 397-404, DOI: 10.1080/03067319.2011.561341.

Y. M. Kim, S. Harrad, R. M. Harrison, Environmental Science & Technology 2001, 35. 997-1004, DOI: 10.1021/es000192y.

F. L. King, W. W. Harrison, Mass Spectrometry Reviews 1990, 9. 285-317, DOI: 10.1002/mas.1280090303.

B. Kolb, L. S. Ettre, Static Headspace-gas Chromatography: Theory and Practice. Wiley-VCH: Hoboken, N.J., J. Am. Chem. Soc., vol. 119, No. 49, 1997 p. 12029.

D.W. Later, J. L. Jones, Edgar D Lee, C. S. Sadowski, K. J. Fredeen, in Pittsburgh Conf. Anal. Chem. Appl. Spectrosc., Orlado, Fl. 2012.

V. Lopez-Avila, J. Cooley, R. Urdahl, M. Thevis, Rapid Communications in Mass Spectrometry 2012, 26. 2714-2724, DOI: 10.1002/rcm.6398.

A. Malcolm, S. Wright, R. R. A. Syms, R. W. Moseley, S. O'Prey, N. Dash, A. Pegus, E. Crichton, G. Hong, A. S. Holmes, A. Finlay, P. Edwards, S. E. Hamilton, C. J. Welch, Rapid Communications in Mass Spectrometry 2011, 25. 3281-3288, DOI: 10.1002/rcm.5230.

R. E. March, D. S. Richards, R. W. Ryan, International Journal of Mass Spectrometry 2006, 249-250. 60-67, DOI: 10.1016/j.iims2005.12.038.

R. E. March, J. F. J. Todd, John Wiley & Sons, Inc. 2005. pp. 199-200, DOI: 10.1002/0471717983.

S. A. McLuckey, G. L. Glish, K. G. Asano, B. C. Grant, Analytical Chemistry 1988, 60. 2220-2227, DOI: 10.1021/ac00171a012.

S. A. McLuckey, G. L. Glish, D. C. Duckworth, R. K. Marcus, Analytical Chemistry 1992, 64. 1606-1609, DOI: 10.1021/ac00038a018.

M. S. B. Munson, F. H. Field, Journal of the American Chemical Society 1966, 88. 2621-2630, DOI: 10.1021/ja00964a001.

Z. Ouyang, R. G. Cooks, J. Hertig, T.-C. Chen, N. Manicke, L. Li, C.-H. Chen, J. Liu, presented in part at ASMS, 60th, Vancouver, CA, Yea.

Z. Ouyang, G. Wu, Y. Song, H. Li, W. R. Plass, R. G. Cooks, Analytical Chemistry 2004, 76. 4595-4605, DOI: 10.1021/ac049420n.

J. B. Plomley, M. Lauŝevic, R. E. March, Mass Spectrometry Reviews 2000, 19. 305-365, DOI: 10.1002/1098-2787(2000)19:5<305::aid-mas4>3.0.co;2-t.

M.-C. Reinnig, L. Müller, J. Warnke, T. Hoffmann, Analytical and Bioanalytical Chemistry 2008, 391. 171-182, DOI: 10.1007/s00216-008-1964-5.

W. J. Richter, H. Schwarz, Angewandte Chemie International Edition in English 1978, 17. 424-439, DOI: 10.1002/anie.197804241.

A. L. Russell, A. J. Bednar, D. K. MacMillan, C. A. Hayes, B. Porter, N. D. Nulherin, L. Parker, Detection of Explosives using a Portable SPME_GC-Cylindrical Ion Trap Mass Spectrometer, in Harsh Environment Mass Spectrometry (HEMS) Conference. Cocoa Beach, FL., 2007.

F. J. Santos, M. T. Galceran, TrAC Trends in Analytical Chemistry 2002, 21. 672-685, DOI: 10.1016/s0165-9936(02)00813-0.

M. Schweigkofler, R. Niessner, Environmental Science & Technology 1999, 33. 3680-3685, DOI: 10.1021/es9902569.

R. T. Short, D. P. Fries, M. L. Kerr, C. E. Lembke, S. K. Toler, P. G. Wenner, R. H. Byrne, Journal of the American Society for Mass Spectrometry 2001, 12. 676-682, DOI: 10.1016/s1044-0305(01)00246-x.

W. J. Sonnefeld, W. H. Zoller, W. E. May, Analytical Chemistry 1983, 55. 275-280, DOI: 10.1021/ac00253a022.

X. Sun, C. M. Zimmermann, G. P. Jackson, C. E. Bunker, P. B. Harrington, Talanta 2011, 83. 1260-1268, DOI: 10.1016/j.talanta.2010.05.063.

K. Tonokura, N. Kanno, Y. Yamamoto, H. Yamada, International Journal of Mass Spectrometry 2010, 290. 9-13, DOI: 10.1016/j.ijms2009.11.004.

(56) References Cited

OTHER PUBLICATIONS

A. Vlasenko, J. G. Slowik, J. W. Bottenheim, P. C. Brickell, R. Y. W. Chang, A. M. Macdonald, N. C. Shantz, S. J. Sjostedt, H. A. Wiebe, W. R. Leaitch, J. P. D. Abbatt, J. Geophys. Res. 2009, 114. D21305, DOI: 10.1029/2009jd012025.

W. Xu, N. N Charipar, M. A. Kirleis, Y. Xia, Z. Ouyang, Analytical Chemistry 2010, 82. 6584-6592, DOI: 10.1021/ac101002t.

M. Yang, T.-Y. Kim, H.-C. Hwang, S.-K. Yi, D.-H. Kim, Journal of the American Society for Mass Spectrometry 2008, 19. 1442-1448, DOI: 10.1016/j.jasms2008.05.011.

S. Kumano, M. Sgiyama, M. Yamada, K. Nishimura, H. Hasegawa, H. Morokuma, H. Inoue, Y. Hashimoto, Development of a Portable Mass Spectrometer Characterized by Discontinuous Sample Gas Introduction, a LowPressure Dialectric Barrier Discharge Ionization Source, and a Vacuumed Headspace Technique, Anal. Chem. 2013, 85, 5033-5039, ACS Publications, DOI: 10.1021/ac4002904.

M. Sugiyama, S. Kumano, K. Nishimura, H. Hasegawa and Y. Hashimoto, Sensitive low-pressure dielectric barrier discharge ion source, Rapid Commun. Mass Spectrom. 2013, 27, 1005-1010, John Wiley & Sons, Ltd., DOI: 10.1002/rcm.6546.

Infinicon, Application Note, Detection and Identification of Stachybotrys schartarum Microbial Volatile Organic Compounds (MVOCs) On-Site Using the HAPSITE ER and Thermal Desorber Sampling System (TDSS), 2011, www.infinicon.com.

A. Gifford, Detection and Identification of Stachubotrys Chartarum Microbial Volatile Organic Compounds (MVOCs) On-Site Using Person-Portable Gas Chromatography/Mass Spectrometry (GC-MS) Using a Thermal Desorption Accessory, Abstract, Mar. 15, 2012, The Pittsburgh Conference on Analytical, Chemistry and Applied Spectroscopy, Inc.

Sodal, et al. "Improved Mass Spectrometer Measurements Using a Pulsed Gas Sampling System", Journal of Vacuum Science and Technology; Part A, vol. 15, No. 1, Jan. 1, 1997, pp. 176-181.

Extended European Search Report, issued in European Patent Application No. 12789951.6, mailed on Feb. 10, 2015.

Fenn, et al., Science, 1989, 246, 64-71.

Carroll et al., Analytical Chemistry, 1975, 47, 2369-2373.

Takats et al., Science, 2004, 306, 471-473.

Cody et al., Analytical Chemistry, 2005, 77, 2297-2302.

* cited by examiner

SYSTEMS AND METHODS FOR ANALYZING A SAMPLE

RELATED APPLICATION

The present application is a continuation of U.S. nonprovisional application Ser. No. 14/058,856, filed Oct. 21, 2013, which is a continuation of international patent application number PCT/US2012/037987, filed May 15, 2012, which claims the benefit of and priority to U.S. provisional application Ser. No. 61/488,244, filed May 20, 2011, the content of each of which is incorporated by reference herein in its entirety.

GOVERNMENT INTEREST

This invention was made with Government support under CHE0847205 awarded by National Science Foundation. The government has certain rights in the invention.

FIELD OF THE INVENTION

The invention generally relates to systems and methods for analyzing a sample.

BACKGROUND

Mass spectrometry is a very sensitive analytical method used for important research and for applications of analytical chemistry, such as life science. A mass spectrometer works by using magnetic and electric fields to exert forces on charged particles (ions) in a vacuum. Therefore, a compound must be charged or ionized to be analyzed by a mass spectrometer. Accordingly, chemical analysis using mass spectrometry involves ionization of molecules in a sample followed by mass analysis of those ions. Typically an ionization source is used to ionize an analyte at atmospheric pressure or inside a vacuum chamber before mass analysis is performed on the produced ions.

Atmosphere based ionization methods involve producing ions at atmospheric pressure and then subsequently transferring those ions into a vacuum chamber that houses a mass analyzer. The ions are then analyzed by the mass analyzer. Examples of such atmosphere based ionization methods include electrospray ionization (Fenn, et al., Science, 1989, 246, 64-71; and Fenn et al., Mass Spectrometry Reviews, 1990, 9, 37-70), and atmospheric pressure chemical ionization (Carroll et al., Analytical Chemistry, 1975, 47, 2369-2373). Recently, ambient ionization methods, including desorption electrospray ionization (Takats et al., Science, 2004, 306, 471-473; Takats et al., U.S. Pat. No. 7,335,897), direct analysis in real time (Cody et al., Analytical Chemistry, 2005, 77, 2297-2302), and others, have been developed to generate analyte ions from complex mixtures for mass analysis. A problem with atmosphere based ionization methods is that the ions from an ion source at atmospheric pressure need to be transferred into vacuum through an atmospheric pressure interface for mass analysis. Generally, the transfer efficiency is 1% or lower.

Methods have been developed in which the sample is ionized within the vacuum chamber, eliminating the need for an ion transfer line. Such methods avoid the ion transfer problems associated with atmosphere ionization methods. Generally, for ionization of an analyte in a vacuum, a photon or electron source, is used to produce a beam of photons or electrons that interacts with the sample in a vacuum chamber. Interaction of the sample with the photons or electrons produces ions that are subsequently analyzed. Exemplary methods include electron impact ionization (Nier et al., Review of Scientific Instruments, 1947, 18, 398-411), laser desorption ionization (Ronald et al., The Rockefeller University, 1989; and U.S. Pat. No. 5,045,694), photo ionization (Lossing et al., The Journal of Chemical Physics, 1956, 25, 1031-1034), chemical ionization (Harrison et al., Ed. Chemical Ionisation Mass Spectrometry; CRC Press, Boca Raton, Fla., 1983), or matrix assisted laser desorption ionization (Karas et al., Analytical Chemistry, 1988, 60, 2299-2301; and Hillenkamp et al., Analytical Chemistry, 1991, 63, 1193A-1203A). Other methods use neutral molecular or ion beams, such as fast atom bombardment ionization (Barber et al., Journal of the Chemical Society, Chemical Communications, 1981, 325-327) and secondary ionization mass spectrometry (Herzog et al., Physical Review, 1949, 76:855-856).

SUMMARY

The invention generally relates to sample analysis by mass spectrometry in which a neutral gas, as opposed to ions, is introduced into a vacuum chamber. In systems and methods of the invention, ionization of the neutral gas occurs in the vacuum chamber by interaction of molecules of the neutral gas with an electric discharge produced between a conducting member within the vacuum chamber and a distal end of a sample introduction member within the chamber. The produced ions are subsequently transferred to a mass analyzer for mass analysis. Systems and methods of the invention produce ions within a vacuum chamber without the need for photon or electron sources. Further, by producing ions within a vacuum chamber, systems and methods of the invention avoid the problems associated with transferring ions from an ion source at atmospheric pressure to a vacuum chamber. In certain embodiments, production of the discharge and ions is triggered and synchronized with the sample introduction without additional control by electronics.

In certain aspects, the invention provides an electric source, a vacuum chamber including a conducting member, in which the conducting member is coupled to the electric source, a sample introduction member coupled to the vacuum chamber, in which a distal end of the sample introduction member resides within the vacuum chamber and proximate the conducting member such that an electrical discharge may be produced between the sample introduction member and the conducting member. The discharge ionizes molecules of a neutral gas introduced into the vacuum chamber, and a mass analyzer within the vacuum chamber analyzes the produced ions.

In particular embodiments, systems and methods of the invention are accomplished with at least one discontinuous atmospheric interface such that pulses of the neutral gas are introduced into the vacuum chamber. The ionization of the neutral gas may be synchronized with a pressure variation in the vacuum chamber that results from operation of the discontinuous atmospheric interface. Generally, the discontinuous atmospheric interface is positioned between the source of the sample and the vacuum chamber. In particular embodiments, the system is configured with two discontinuous atmospheric interfaces that are arranged sequentially. Use of the discontinuous atmospheric interface allows for the neutral gas to be pulsed into the vacuum chamber. Additionally, the use of the discontinuous atmospheric interface allows for ionization of the neutral gas to be synchronized with a pressure variation generated from opening and closing the discontinuous atmospheric interface.

The discontinuous atmospheric interface may include a valve for controlling entry of gas into the mass analyzer such that the gas is transferred into the mass analyzer in a discontinuous mode. Any valve known in the art may be used. Exemplary valves include a pinch valve, a thin plate shutter valve, leak valve, and a needle valve. The atmospheric pressure interface may further include a tube, in which an exterior portion of the tube is aligned with the valve.

In particular embodiments, the discontinuous atmospheric pressure interface includes a valve, a tube configured such that an exterior portion of the tube is aligned with the valve, and a first capillary inserted into a first end of the tube and a second capillary inserted into a second end of the tube, in which neither the first capillary nor the second capillary overlap with a portion of the tube that is in alignment with the valve.

The sample introduction member may be any device known in the art for directing or flowing gas and can be made of any material. In certain embodiments, the sample introduction member is a metal capillary tube. The conducting member may be any device known in the art that can conduct electricity. In certain embodiments, the conducting member is a metal mesh.

Any mass analyzer known in the art may be used with systems of the invention. Exemplary mass analyzers include a quadrupole ion trap, a rectalinear ion trap, a cylindrical ion trap, a ion cyclotron resonance trap, or an orbitrap. The mass analyzer may be for a mass spectrometer or a handheld mass spectrometer.

Another aspect of the invention provides a method for analyzing a sample that involves introducing a neutral gas into a vacuum chamber via a sample introduction member, in which the vacuum chamber includes a conducting member, producing ions within the vacuum chamber by interaction of molecules of the gas with an electrical discharge generated between a distal end of the sample introduction member and the conducting member, and analyzing the ions.

In certain embodiments, the neutral gas is discontinuously introduced into the vacuum chamber. Discontinuously introducing the gas into the chamber may involve opening a valve connected to the sample introduction member, in which opening of the valve allows for transfer of the neutral gas substantially at atmospheric pressure to the vacuum chamber at reduced pressure, and closing the valve connected to the sample introduction member, in which closing the valve prevents additional transfer of the gas substantially at atmospheric pressure to the mass vacuum chamber at reduced pressure. In certain embodiments, producing ions is synchronized with a pressure variation generated from opening and closing the discontinuous atmospheric interface.

Analyzing may include providing a mass analyzer to generate a mass spectrum of the ions produced from the neutral gas. Exemplary mass analyzers include a quadrupole ion trap, a rectilinear ion trap, a cylindrical ion trap, an ion cyclotron resonance trap, and an orbitrap. A method for analyzing a sample, the method comprising:

Another aspect of the invention provides a method for analyzing a sample that involves introducing a neutral gas including particles into a vacuum chamber via a sample introduction member, in which the vacuum chamber includes a conducting member, producing ions within the vacuum chamber by interaction of particles in the gas with an electrical discharge generated between a distal end of the sample introduction member and the conducting member, and analyzing the ions. The particles may be any type of particles, for example solid particles, liquid droplets, or a combination thereof.

DETAILED DESCRIPTION

The invention generally relates to systems and methods for analyzing a sample. In certain embodiments, the invention provides systems for analyzing a sample that include an electric source, a vacuum chamber including a conducting member, in which the conducting member is coupled to the electric source, a sample introduction member coupled to the vacuum chamber, in which a distal end of the sample introduction member resides within the vacuum chamber and proximate the conducting member such that an electrical discharge may be produced between the sample introduction member and the conducting member, in which the discharge ionizes molecules of a neutral gas introduced into the vacuum chamber, and a mass analyzer within the vacuum chamber.

Figure 1:
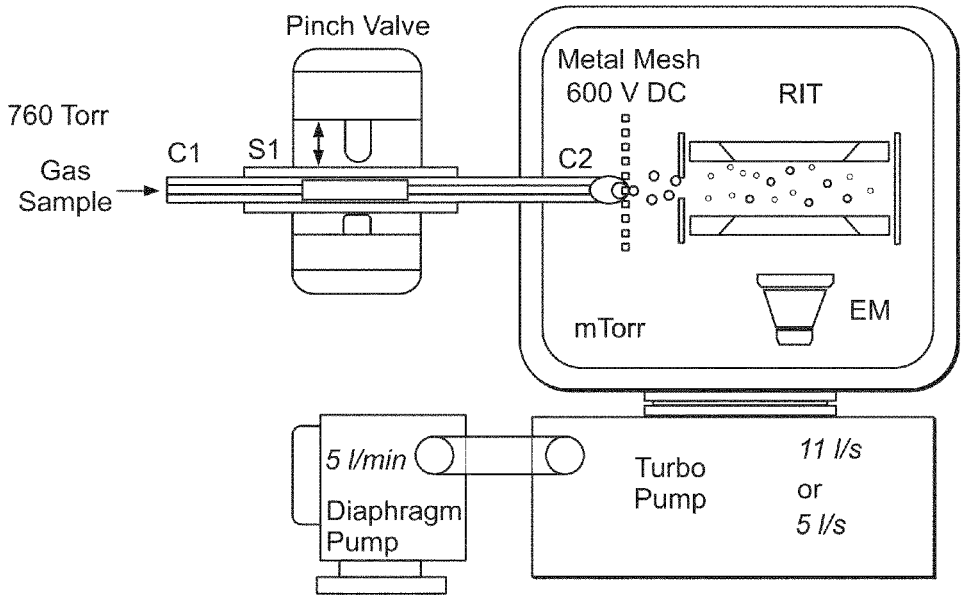
FIG. 1 is a schematic showing an instrument setup for chemical analysis using synchronized discharge ionization and an ion trap mass analyzer.

FIG. 1 is a schematic showing an embodiment of systems of the invention. This embodiment shows a sample introduction member in which a proximal end of the line resides at atmospheric pressure and a distal end of the line resides in a vacuum chamber. In this manner, a neutral gas may be introduced through the sample introduction member and into the vacuum chamber. The sample introduction member may be made of any material that conducts electricity.

The vacuum chamber includes a mass analyzer and a conducting member that resides within the vacuum chamber. Any mass analyzer known in the art may be used with systems of the invention. Exemplary mass analyzers include a quadrupole ion trap, a rectilinear ion trap, a cylindrical ion trap, a ion cyclotron resonance trap, and an orbitrap. The conducting member is positioned proximate to the distal end of the sample introduction member that also resides in the vacuum chamber. The conducting member is connected to an electric source, such as a DC electric source. In the context of systems of the invention, proximate refers to a position close enough that an electric discharge may be generated between the distal end of the sample introduction member and the conducting member.

In operation, a neutral gas is introduced through the sample introduction member into the vacuum chamber. An electric voltage, such as a DC electric voltage, is applied to the conducting member in the presence of the neutral gas. Due to the proximity of conducting member and the distal end of the sample introduction member, an electric discharge is produced between the conducting member and the distal end of the sample introduction member. Molecules of the neutral gas interact with the discharge to form ions, which are subsequently transferred to the mass analyzer by a combination of the electric discharge and the gas flow.

In the embodiment shown in FIG. 1, the sample introduction member is shown integrated with a discontinuous atmospheric interface. One of skill in the art will appreciate that the discontinuous atmospheric interface is an optional component of systems and methods of the invention and that systems and methods of the invention can operate without the use of a discontinuous atmospheric interface. The discontinuous atmospheric interface is discussed in greater detail below. Briefly, the discontinuous atmospheric interface shown in FIG. 1 includes a valve for controlling entry of gas into the vacuum chamber such that the gas is transferred into the mass analyzer in a discontinuous mode. Any valve known in the art may be used. Exemplary valves include a pinch valve, a thin plate shutter valve, leak valve, and a needle valve. The atmospheric pressure interface may further include a tube, in which an exterior portion of the tube is aligned with the valve. Generally, two stainless steel capillaries are connected to the piece of silicone plastic tubing, the open/closed status of which is controlled by the pinch valve.

Figure 2A:
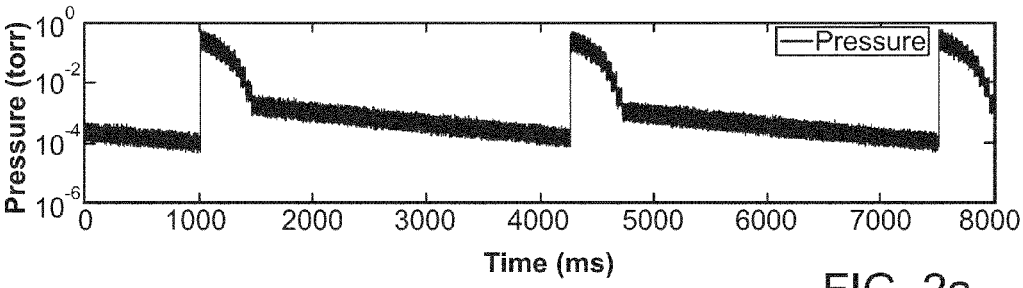
FIG. 2 is a set of graphs showing the variations in (a) the pressure of the vacuum manifold, (b) the voltage applied on the metal mesh, and (c) the current through the end electrode of the rectilinear ion trap during the operation of the pulse valve.
Figure 2B:
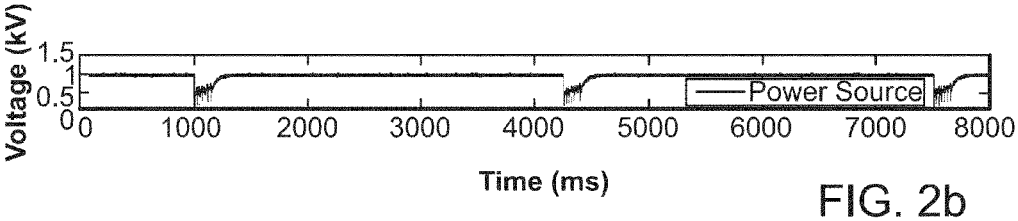
Figure 2C:
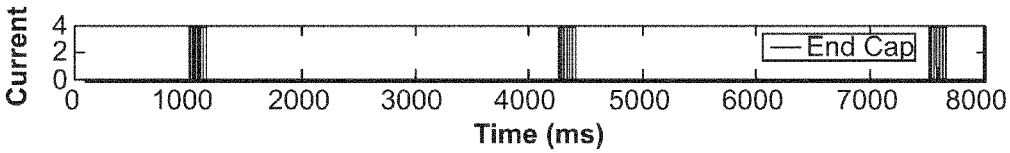

As shown in FIG. 1, a pulse of gas can be introduced into the vacuum to result in an increase of the pressure inside the vacuum. The pressure variation for operating the pulsed valve at a frequency of 0.3 Hz is shown in FIG. 2. By applying a DC voltage between the metal capillary C2 and a metal mesh, discharge occurs when the pressure is higher than a certain value which ionizes the analyte molecules in the gas sample (FIGS. 2*b* and *c*). The ions are transferred into the mass analyzer, by the gas flow and the electric field, and trapped for mass analysis. After the valve is closed, the pressure decreases and the discharge stops automatically. The ionization process is synchronized with the sample introduction. The minimum pressure for the discharge is dependent on the electric field and the type of gas, which can be determined with Paschen's curves for the different gases.

Figure 3A:
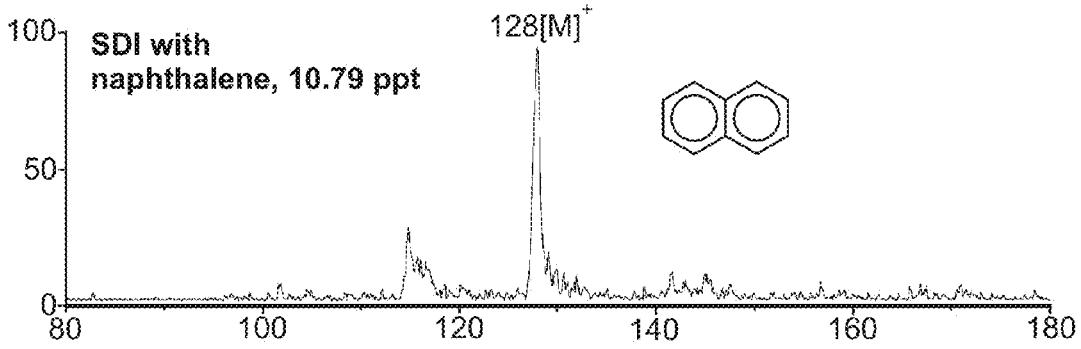
FIG. 3 is a set of mass spectra of chemical vapors in air, (a) 200 ppt naphthalene, (b) dimethyl methylphosphonate, and (c) methyl salicylate vapor.
Figure 3B:
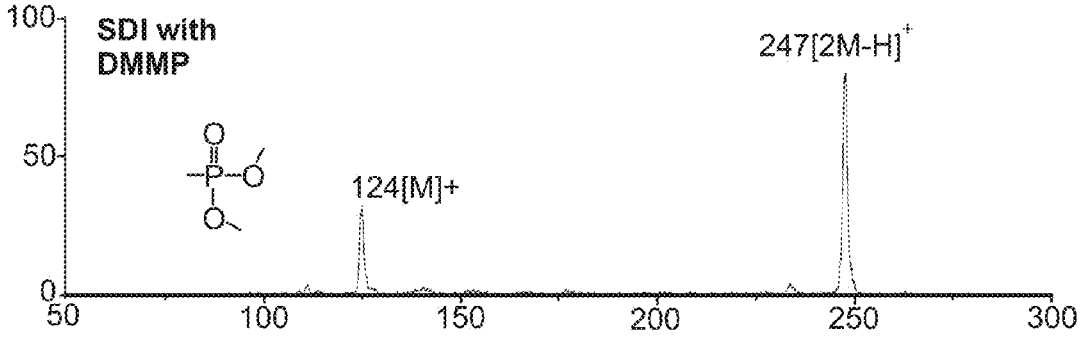
Figure 3C:
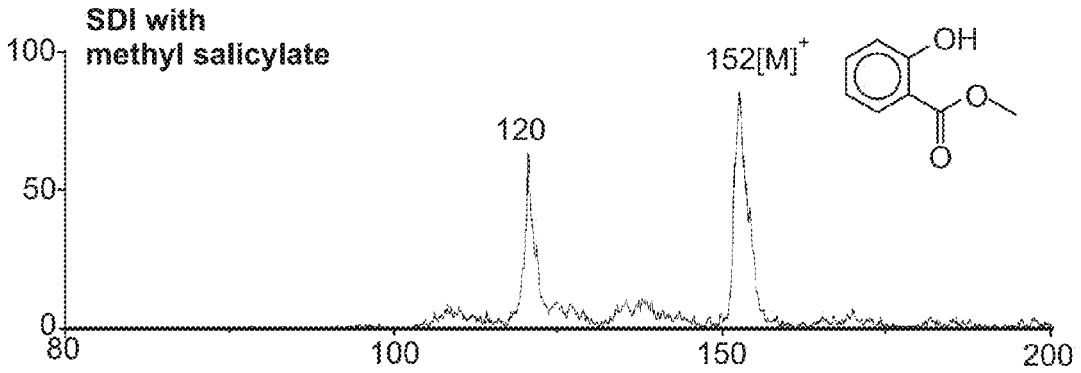

Data have been obtained using the setup shown in FIG. 1. Spectra were recorded for naphthalene in air at low concentrations (FIG. 3*a*) The molecular radical cation m/z 128 was observed. FIG. 3*b* shows a spectrum for dimethyl methylphosphonate in air and FIG. 3*c* shows a spectrum of methyl salicylate vapor in air.

Figure 4:
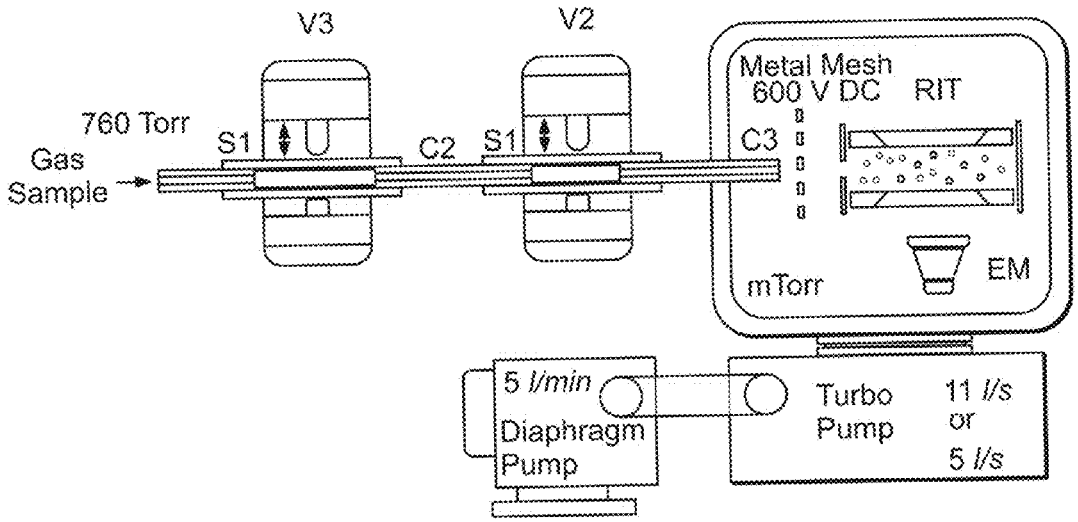
FIG. 4 is a schematic showing a setup for using capillary c2 to control the volume of the sample to be introduced.
Figure 5:
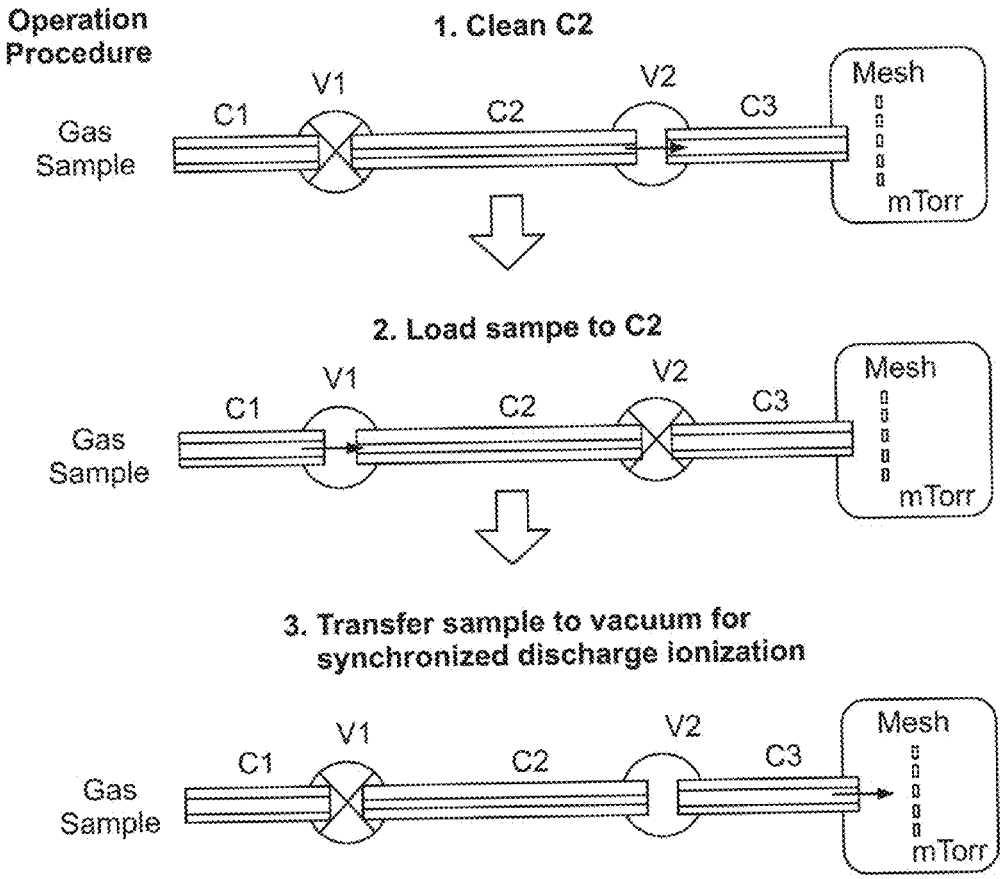
FIG. 5 is a schematic showing an operation procedure for using the setup shown in FIG. 4 for mass analysis with synchronized discharge ionization.

In certain embodiments, systems and methods of the invention have two discontinuous atmospheric interfaces integrated into the sample introduction member, as shown in FIG. 4. FIG. 4 shows a setup to use a capillary C2 with a defined volume to precisely control the amount of gas sample to be introduced into the vacuum for analysis. An example of the operation procedure is shown in FIG. 5. The Valve 2 is first opened so the pressure inside the C2 will decrease to the same pressure inside the vacuum manifold $P_v$. After Valve 2 is completely closed, the Valve 1 is opened to fill the C2 with gas sample and the pressure inside C2 will reach the atmospheric pressure $P_{atm}$. The Valve 1 is then closed and the Valve 2 is opened again to allow the gas samples inside the C2 to be released into the vacuum. The pressure of the vacuum manifold increases, the discharge occurs, the analyte molecules in the gas are ionized and introduced into the mass analyzer. A constant volume of gas $V_{c2}$ is introduced into the vacuum manifold each time and the reproducibility of the quantitative analysis will be improved.

Discontinuous Atmospheric Interface (DAI)

Discontinuous atmospheric interfaces are described in (Ouyang et al., U.S. patent application number 2010/0301209 and PCT application number PCT/US2008/065245), the content of each of which is incorporated by reference herein in its entirety.

The concept of the DAI is to open its channel during ion introduction and then close it for subsequent mass analysis during each scan. An ion transfer channel with a much bigger flow conductance can be allowed for a DAI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A DAI opens and shuts down the airflow in a controlled fashion. The pressure inside the vacuum manifold increases when the API opens and decreases when it closes. The combination of a DAI with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between $10^{-3}$ to $10^{-10}$ torr depending the type of mass analyzer. The larger the opening in an atmospheric pressure interface, the higher is the ion current delivered into the vacuum system and hence to the mass analyzer.

An exemplary embodiment of a DAI is shown in FIG. 1. The DAI includes a pinch valve that is used to open and shut off a pathway in a silicone tube connecting regions at atmospheric pressure and in vacuum. A normally-closed pinch valve (390NC24330, ASCO Valve Inc., Florham Park, N.J.) is used to control the opening of the vacuum manifold to atmospheric pressure region. Two stainless steel capillaries are connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. One or Both stainless steel capillaries may be grounded. The pumping system of the mini 10 consists of a two-stage diaphragm pump 1091-N84.0-8.99 (KNF Neuberger Inc., Trenton, N.J.) with pumping speed of 5 L/min (0.3 $m^3$/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD 011 turbomolecular pump cannot be turned on. When the pinch valve is de-energized, the plastic tubing is squeezed closed and the turbo pump can then be turned on to pump the manifold to its ultimate pressure in the range of $1\times10^{-5}$ torr.

The sequence of operations for performing mass analysis using ion traps usually includes, but is not limited to, ion introduction, ion cooling and RF scanning. After the manifold pressure is pumped down initially, a scan function is implemented to switch between open and closed modes for ion introduction and mass analysis. During the ionization time, a 24 V DC is used to energize the pinch valve and the API is open. The potential on the rectilinear ion trap (RIT) end electrode is also set to ground during this period. A minimum response time for the pinch valve is found to be 10 ms and an ionization time between 15 ms and 30 ms is used for the characterization of the discontinuous API. A cooling time between 250 ms to 500 ms is implemented after the API is closed to allow the pressure to decrease and the ions to cool down via collisions with background air molecules. The high voltage on the electron multiplier is then turned on and the RF voltage is scanned for mass analysis. During the operation of the discontinuous API, the pressure change in the manifold can be monitored using the micro pirani vacuum gauge (MKS 925C, MKS Instruments, Inc. Wilmington, Mass.) on Mini 10 portable system.

Incorporation by Reference

References and citations to other documents, such as patents, patent applications, patent publications, journals, books, papers, web contents, have been made throughout this disclosure. All such documents are hereby incorporated herein by reference in their entirety for all purposes.

Equivalents

The invention may be embodied in other specific forms without departing from the spirit or essential characteristics thereof. The foregoing embodiments are therefore to be considered in all respects illustrative rather than limiting on the invention described herein.

EXAMPLES

Example 1

Instrument Configuration

Figure 6A:
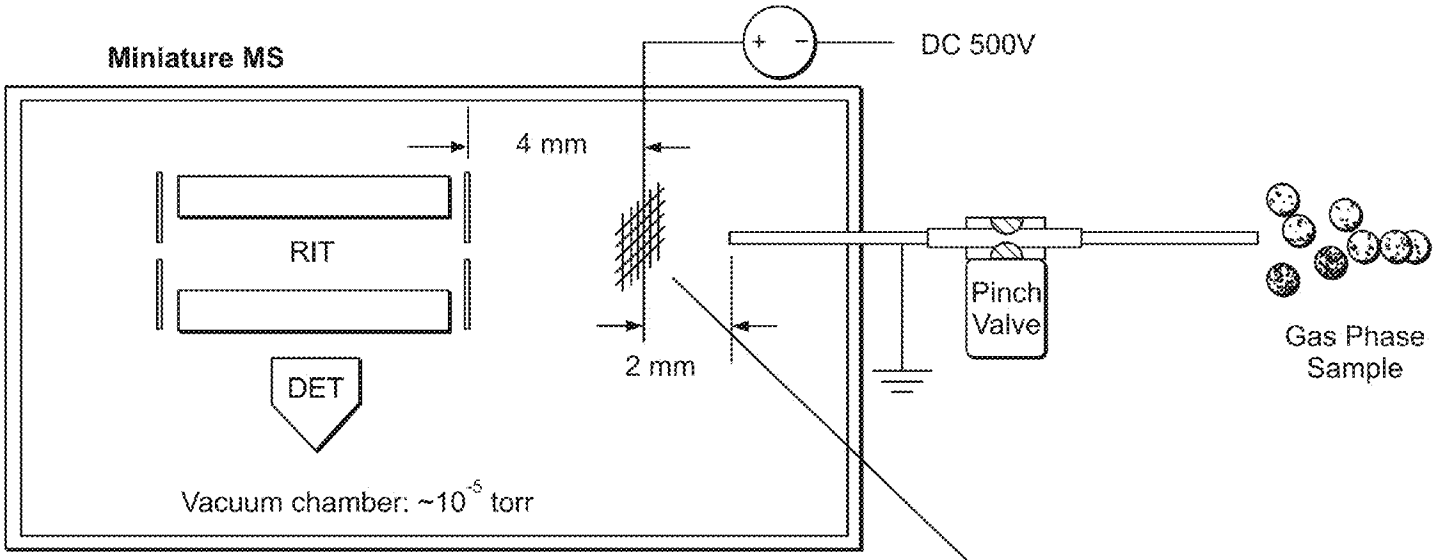
FIG. 6 (a) Schematic diagram of the SDI-MS system, (b) Equivalent circuit for SDI, and (c) Photo showing the glow during the discharge in manifold when the DAI was opened.

A Mini 11 handheld MS system was modified as shown in FIG. 6*a*. The sample introduction was controlled by a discontinuous atmospheric interface (DAI) that included of a pinch valve (390NC24330, ASCO Valve Inc., Florham Park, N.J., USA), a conductive silicone tube (i.d. 1/16 in., o.d. 1/8 in., and length 20 mm, Simolex Rubber Corp., Plymouth, Mich., USA), and two 5 cm long stainless steel capillaries (i.d. 0.04 inch, o.d. 1/16 inch). A stainless steel 316 woven wire mesh (McMaster-Carr, Chicago, Ill., USA) with a grid size of 0.0098" and a wire diameter of 0.0037" (52.7% transparency) was placed between the DAI capillary and the rectilinear ion trap (RIT) in the vacuum chamber. The gaps were ~2 mm between the capillary and the mesh and ~4 mm between the mesh and the front z-electrode of the RIT. The metal mesh was connected to a DC voltage power supply (Ortec 659, AMETEC Inc., Oak Ridge, Tenn., USA) through an adjustable resistor for limiting the discharge current. The capillary was grounded.

The DC power supply has an internal impendence of about 2MΩ and provides a constant DC voltage with an output current lower than 100 μA. The discharge current was limited by the power supply internal impedance and the adjustable resistor ($R_1$). The equivalent circuit is shown in FIG. 1*b*. The capillary-mesh assembly initially behaved as a capacitor ($C_1$; Y. P. Raizer, 2nd ed., Springer, Berlin, 1991). When the discharge was established and sustained, the current between the discharge electrodes was constant and the discharge area was equivalent to a regular resistor ($R_2$).

Example 2

Discharge and Ionization

Figure 6C:
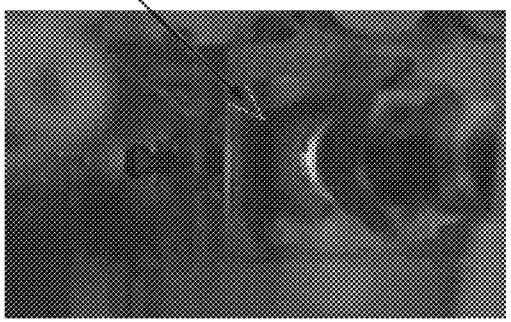
Figure 6B:
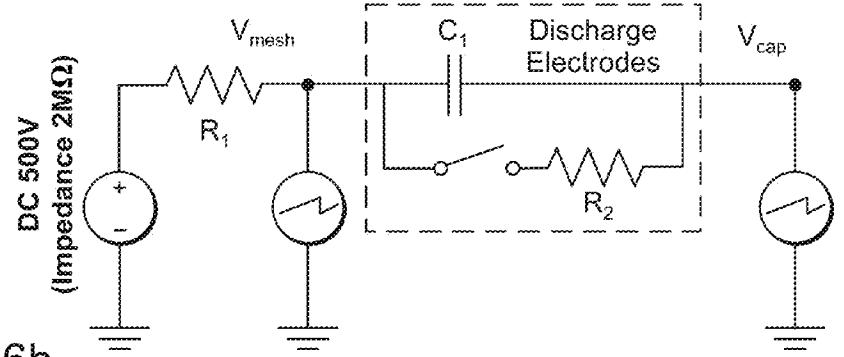
Figure 7:
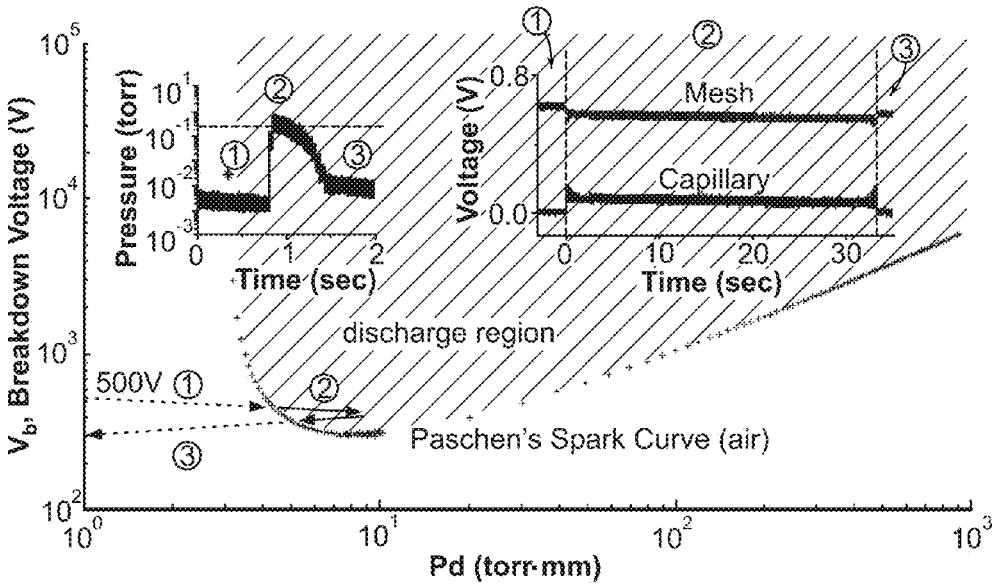
FIG. 7 is a schematic showing Paschen's curve for air, the pressure variation measured in the manifold (left inset), and the variation in voltage on the mesh (right inset) during sample introduction.

In a system of the invention, the discharge process was governed by Paschen's law (FIG. 7) and was synchronized with the variation of the pressure. Before the DAI opened, the pressure in the manifold was low (typically ~$10^{-5}$ torr; step ① in FIG. 7). The voltage applied on the two discharge electrodes remained constant. When the DAI opened, the neutral analyte molecules in the air were introduced into the chamber. The pressure between the discharge electrodes rose and the discharge occurred when the pressure exceeded the breakdown point. The breakdown condition was dependent on both the pressure and the electric field (F. Paschen, Annalen der Physik, 1889). A glow was observed during the discharge (FIG. 6*c*) and the analyte molecules were ionized (step ② in FIG. 7). The ions generated were transferred into the RIT mass analyzer and trapped. After the DAI was closed, the pressure decreases due to the continuous gas pumping out and the discharge stopped (step ③ in FIG. 7). As a summary, the ionization in the systems of the invention was synchronized with the opening and closing of the DAI through the variation of the chamber pressure, and the discharge was automatically turned on and off. No fragile component, like a filament for electron impact (EI), or additional electronics for operation synchronization were required.

Example 3

SDI in Positive and Negative Mode

Figure 8A:
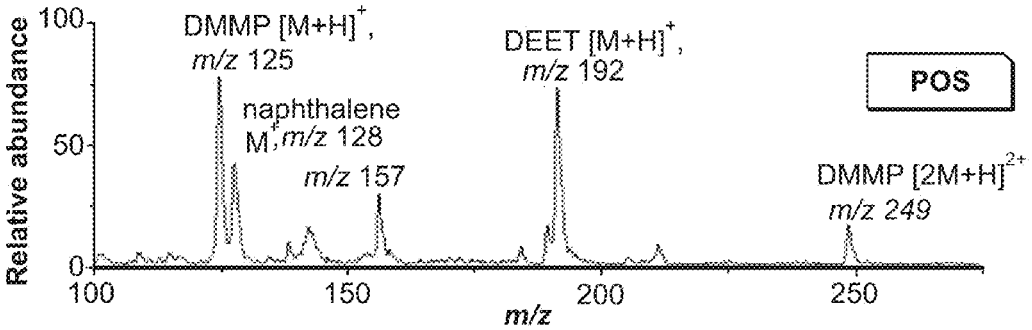
FIG. 8 is a schematic showing MS spectra of (a) headspace vapors from the mixture of 20 μL DMMP, 0.13 mg naphthalene and 310 μL DEET in 1800 uL methanol, in positive mode, (b) 3-Nitrophenol in air (3.5 ppm), negative mode and (c) 1,4-benzoquinone in air, negative mode.
Figures 8B, 8C:
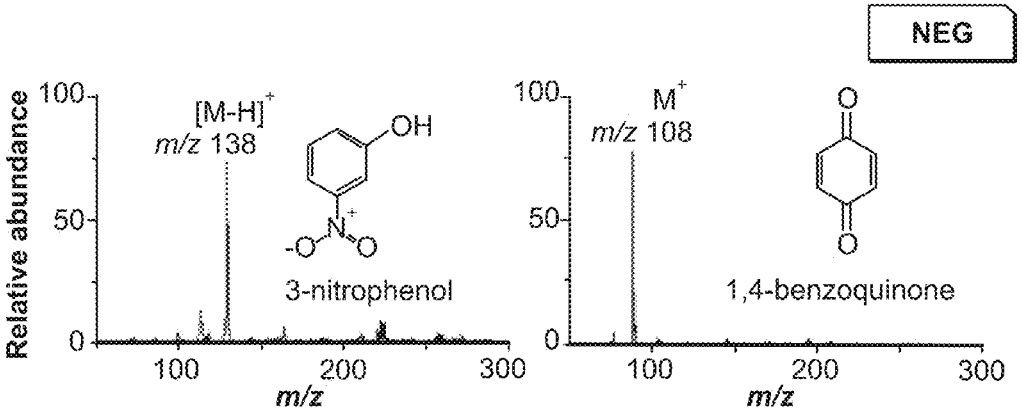

As shown in FIG. 8, systems of the invention allowed for intact molecular ions to be generated in both positive and negative mode for a variety of volatile organic compounds in air (i.e., a soft ionization method). $M^+$ ions from naphthalene and $[M+H]^+$ from DMMP and DEET were observed in positive mode. $M^-$ ions from 1,4-benzoquinone and $[M-H]^-$ from 3-Nitrophenol were observed in negative mode. As for a comparison, these compounds were also tested with atmospheric pressure chemical ionization (APCI) on the same MS system, while naphthalene and 1,4-benzoquinone were not be ionized by APCI in positive and negative mode, respectively.

Example 4

Analytical Performance of Systems of the Invention

Figure 9A:
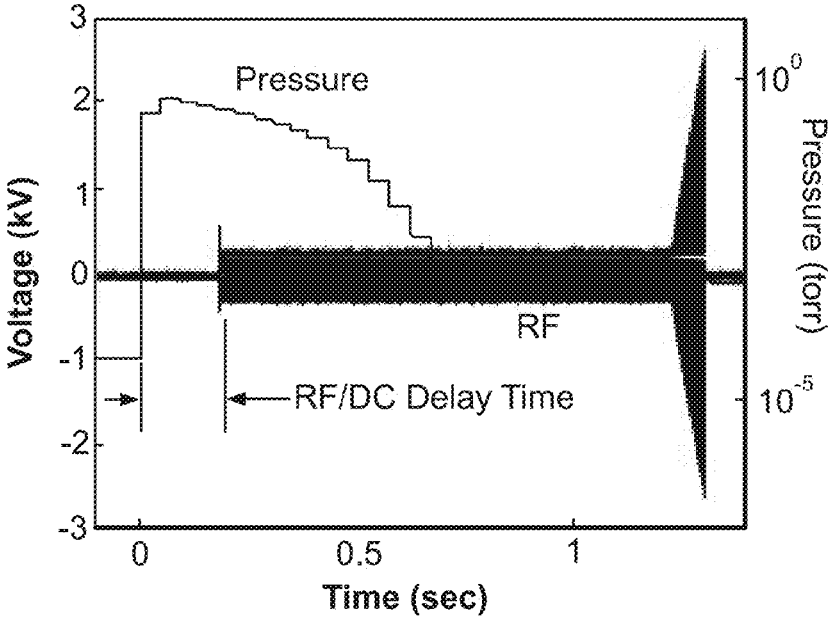
FIG. 9 is a set of graphs showing (a) the pressure variation during a single scan and a delay in trapping with the RF and Z-direction DC potential turned on after a controlled time, and (b) ion abundance as a function of delay time for DAI open time 6 and 7 ms. Inset: ion generation rate during the DAI open time.
Figure 9B:
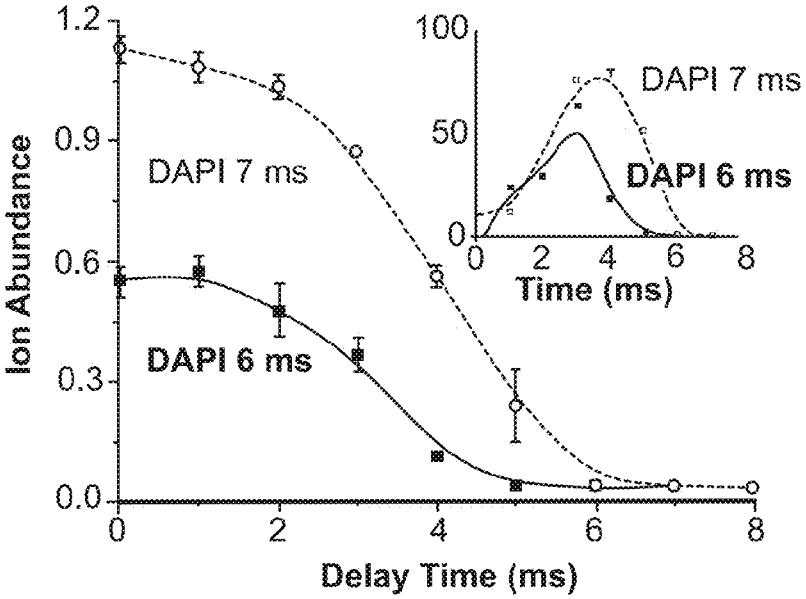

Systems of the invention were characterized by monitoring ion abundance with the delay of the ion trapping in the trap (FIG. 9*a*). The pressure and the ion abundances were both recorded and the delays increased 1 ms for each test. The headspace vapor of 1% dimethyl methylphosphonate (DMMP, vapor pressure=112 Pa at 25° C.; T. E. Mlsna, S. Cemalovic, M. Warburton, S. T. Hobson, D. A. Mlsna, S. V. Patel. Chemicapacitive microsensors for chemical warfare agent and toxic industrial chemical detection. Sensors and Actuators B: Chemical 2006, 116, 192) in methanol was analyzed. The voltage on the mesh was set to about 500 V. The ion abundance as a function of the delay time was plotted for the DAI open time of 6 and 7 ms as shown in FIG. 9*b*. A long DAI open time (7 ms) resulted in overall higher ion abundance. The ion generation rates were calculated and plotted in the inset of FIG. 9*b*. Ions were mostly generated in the middle of the DAI open period.

A previous study using external ionization source with DAI had shown that a longer DAI open time resulted in a higher ion intensity (L. Gao, G. Li, Z. Nie, J. Duncan, Z. Ouyang, R. G. Cooks. Characterization of a discontinuous atmospheric pressure interface. Multiple ion introduction pulses for improved performance. International Journal of Mass Spectrometry 2009, 283, 30). Inside the manifold for systems of the invention, the higher intensity observed with longer DAI open time (7 ms) could be due to both the longer open time as well as a better ion trapping at higher pressure. Variation in the DAI open time leads to difference in the profile of the pressure change. The pressure decrease was slower with a longer DAI open time and the discharge time was therefore also extended (FIG. 9*b*).

Figure 10A:
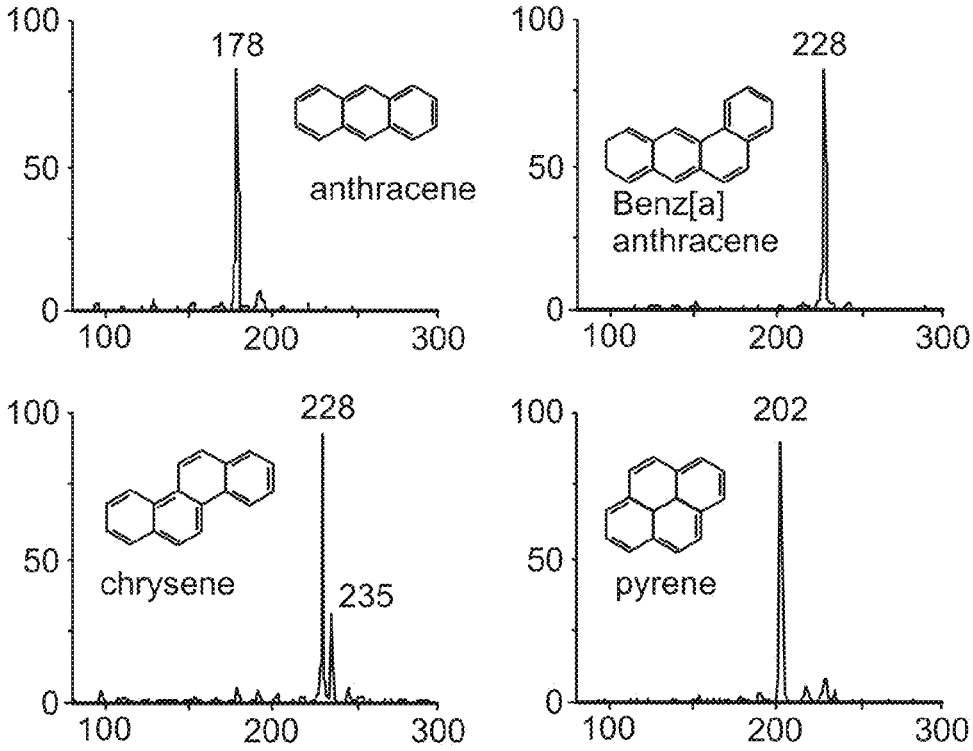
FIG. 10 (*a*) MS spectra of anthrancene, benz[α] anthracere, chrysene and pyene and (b) the calibration curve for naphthalene in air.
Figure 10B:
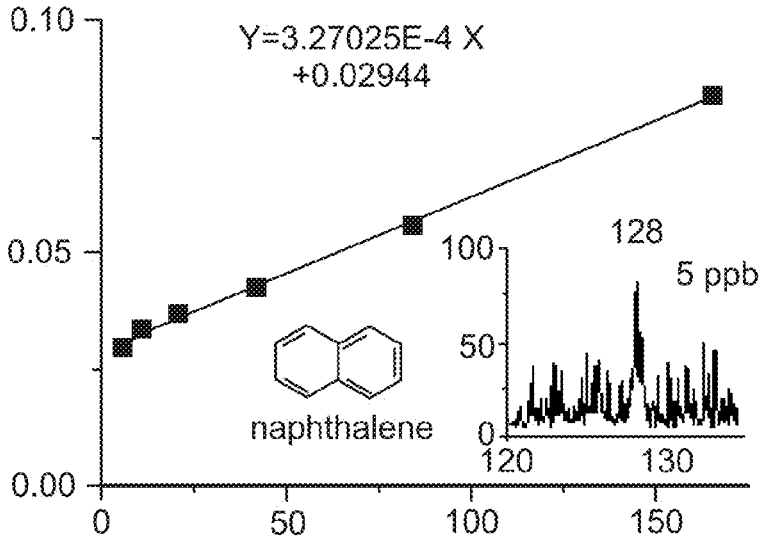

Five chemicals selected from 16 priority PAHs listed by US EPA, anthracene (m/z 178), benz[α] anthracene (m/z 228), chrysene (m/z 228) and pyrene (m/z 202) were analyzed using the system described herein (FIG. 10*a*). Samples of naphthalene in air at concentrations from 5 ppb to 165 ppb were each release to the vicinity of the DAI inlet at a rate of 5 mL/min using a 25 ml syringe (GASTTIGHT 1025, HAMILTON Co., Reno, Nev., USA) with a syringe pump (SP200i, WPI, Hertfordshire SG4 OTJ, UK). The intensity of the naphthalene ion $M^+$ (m/z 128) observed was plotted as a function of the concentration in FIG. 10*b* with a linearity of $R_2$=0.997. The spectrum for 5 ppb is shown in the inset of FIG. 10*b*.

Example 5

Optimization

Figures 11A, 11B:
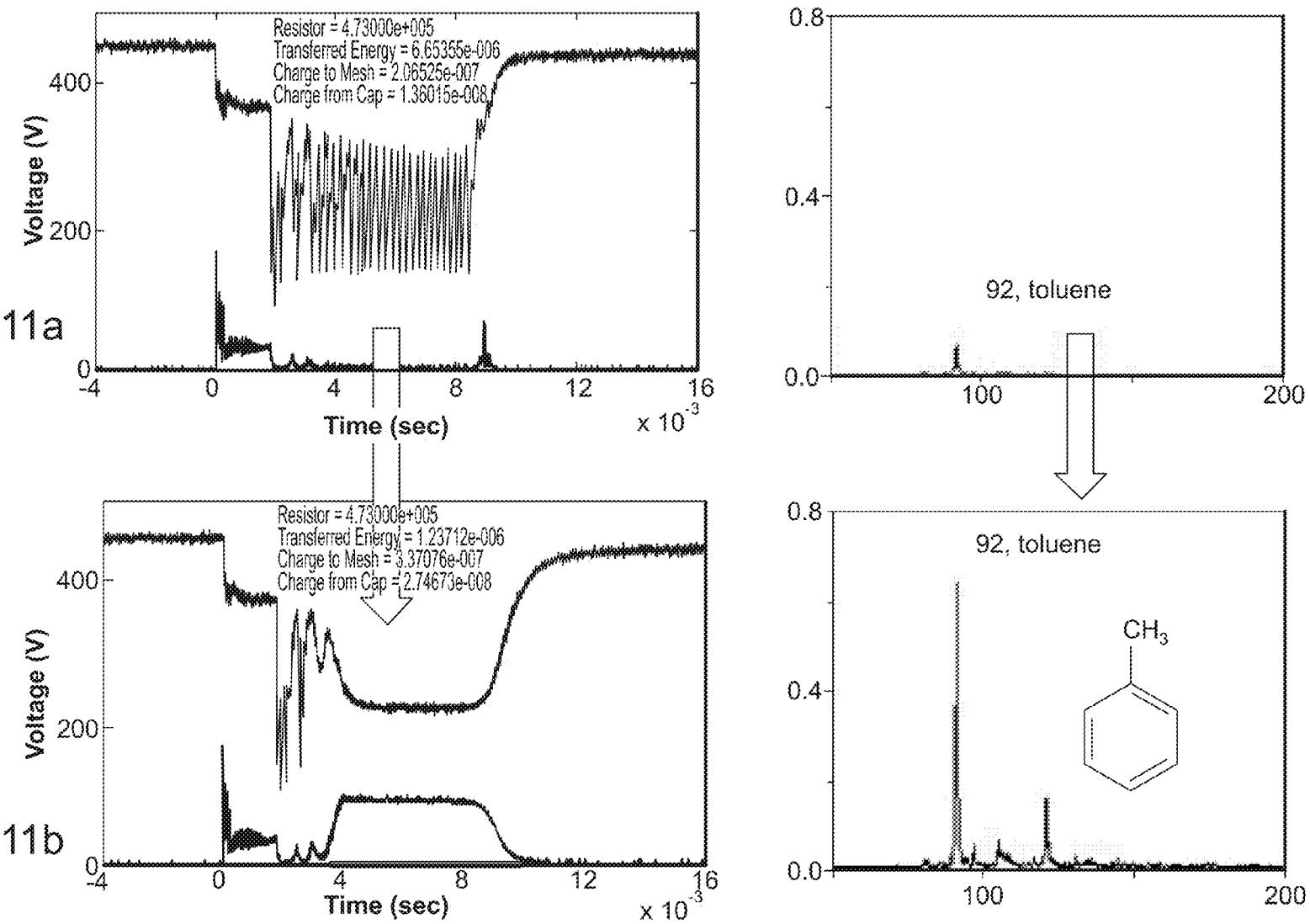
FIG. 11 is a schematic showing a discharge patterns (left) and MS spectra (right) (a) before and (b) after the optimization.

The stability of the discharge is important for the ionization efficiency as well as the quantitative analysis using the systems of the invention. Generally the discharge process can be controlled by varying the chamber pressure and the electric field (through the distance between the discharge electrodes and/or the voltage applied). As an example, the discharge stability was improved by lowering the maximum pressure in the manifold during the DAI operation, which helped to prevent the current being overdrawn during the discharge (FIG. 11). The ion intensity was increased more than 10 times.

What is claimed is:

1. A sample analysis system, the system comprising:

a discontinuous sample introduction interface;

an ionization mechanism comprising a tube and an electrode; and a mass analyzer for a miniature mass spectrometer that is located in a vacuum chamber that is separate and distinct from and operably associated with the ionization mechanism, wherein the ionization mechanism is positioned between the discontinuous sample introduction interface and the mass analyzer to interact with a sample gas after it has passed through the discontinuous sample introduction interface and produce ions of the sample gas that are received by the mass analyzer from the separate and distinct ionization mechanism, and wherein operation of the ionization mechanism is synchronized with opening and closing of the discontinuous sample introduction interface.

2. The system according to claim 1, wherein the mass analyzer is selected from the group consisting of: a quadrupole ion trap, a rectalinear ion trap, a cylindrical ion trap, a ion cyclotron resonance trap, and an orbitrap.

3. The system according to claim 1, wherein the discontinuous sample introduction interface comprises: a valve for controlling movement of the sample gas into the system.

4. The system according to claim 1, wherein valve is a pinch valve.

5. The system according to claim 3, wherein discontinuous sample introduction interface further comprises a tube, wherein an exterior portion of the tube is aligned with the valve.

6. The system according to claim 5, wherein the tube is a silicon plastic tube.

7. The system according to claim 5, wherein discontinuous sample introduction interface further comprises a capillary inserted into a first end of the tube, wherein the capillary does not overlap with a portion of the tube that is in alignment with the valve.

8. The system according to claim 7, wherein the capillary is a stainless steel capillary.

9. The system according to claim 1, wherein the ionization source produces a discharge that interacts with the sample gas to produce the ions.

10. The system according to claim 1, wherein the system further comprises one or more pumps operably coupled to the vacuum chamber.

11. A sample analysis system, the system comprising:

a discontinuous sample introduction interface;

an ionization mechanism comprising a tube and an electrode;

a mass analyzer for a miniature mass spectrometer that is located in a vacuum chamber that is separate and distinct from and operably associated with the ionization mechanism, wherein the ionization mechanism is positioned between the discontinuous sample introduction interface and the mass analyzer to interact with a sample gas after it has passed through the discontinuous sample introduction interface and produce ions of the sample gas that are received by the mass analyzer from the separate and distinct ionization mechanism; and a computer operably connected to the system, wherein the computer contains a processor configured to execute a computer readable program that causes the system to:

open a channel of the discontinuous interface;

apply low RF voltage in the mass analyzer to trap ions in the mass analyzer, the mass analyzer being above a pressure at which mass analysis or ion manipulation can be conducted;

close the channel of the discontinuous interface;

evacuate the mass analyzer to a pressure at which mass analysis or ion manipulation can be conducted; and conduct mass analysis of the ions in the mass analyzer.

12. The system according to claim 11, wherein the mass analyzer is selected from the group consisting of: a quadrupole ion trap, a rectalinear ion trap, a cylindrical ion trap, a ion cyclotron resonance trap, and an orbitrap.

13. The system according to claim 11, wherein the discontinuous sample introduction interface comprises: a valve for controlling movement of the sample gas into the system.

14. The system according to claim 11, wherein valve is a pinch valve.

15. The system according to claim 13, wherein discontinuous sample introduction interface further comprises a tube, wherein an exterior portion of the tube is aligned with the valve.

16. The system according to claim 15, wherein the tube is a silicon plastic tube.

17. The system according to claim 15, wherein discontinuous sample introduction interface further comprises a capillary inserted into a first end of the tube, wherein the capillary does not overlap with a portion of the tube that is in alignment with the valve.

18. The system according to claim 17, wherein the capillary is a stainless steel capillary.

19. The system according to claim 11, wherein the ionization source produces a discharge that interacts with the sample gas to produce the ions.

20. The system according to claim 11, wherein the system further comprises one or more pumps operably coupled to the vacuum chamber.

* * * * *